US007712442B2

(12) United States Patent
Bösl-Flierl et al.

(10) Patent No.: US 7,712,442 B2
(45) Date of Patent: May 11, 2010

(54) VARIABLE VALVE LIFT CONTROL SYSTEM FOR A COMBUSTION ENGINE WITH UNDERNEATH CAMSHAFT

(75) Inventors: Gerlinde Bösl-Flierl, Kalserslautern (DE); Rudolph Flierl, Kaiserslautern (DE)

(73) Assignee: Entec Consulting GmbH, Hemer (DE)

( * ) Notice: Subject to any disclaimer, the term of this patent is extended or adjusted under 35 U.S.C. 154(b) by 632 days.

(21) Appl. No.: 10/550,940

(22) PCT Filed: Mar. 26, 2004

(86) PCT No.: PCT/EP2004/003265

§ 371 (c)(1),
(2), (4) Date: Oct. 6, 2006

(87) PCT Pub. No.: WO2004/088099

PCT Pub. Date: Oct. 14, 2004

(65) Prior Publication Data

US 2007/0074687 A1 Apr. 5, 2007

(30) Foreign Application Priority Data

Mar. 29, 2003 (DE) ..... 103 14 683

(51) Int. Cl.
*F01L 1/34* (2006.01)

(52) U.S. Cl. ..... 123/90.16; 123/90.15

(58) Field of Classification Search ..... 123/90.15, 123/90.16, 90.31

See application file for complete search history.

(56) References Cited

U.S. PATENT DOCUMENTS 2,880,711 A 4/1959 Roan
4,572,118 A 2/1986 Baguena
2002/0162522 A1 11/2002 Morrn

FOREIGN PATENT DOCUMENTS

| | | |
|---|---|---|
| CH | 174762 | 1/1935 |
| DE | 1751690 | 1/1971 |
| DE | 2251091 | 5/1974 |
| DE | 2256091 | 5/1974 |

(Continued)

*Primary Examiner*—Zelalem Eshete
(74) *Attorney, Agent, or Firm*—Margaret Polson; Oppedahl Patent Law Firm LLC

(57) ABSTRACT

In order to produce a variable valve lift control system for a combustion engine with underneath camshaft for the adjustment of a valve lift and an opening time of at least one inlet valve and/or outlet valve, load-dependently and rotation speed dependently as well as for the switch-off of individual cylinders of an internal combustion engine, it is suggested that an underneath camshaft (1) drives by means of a push rod (3) via a hydraulic valve clearance adjustment element (2) a rocker lever (4), which has a curve contour (14), which runs on a roller (13) of an intermediate lever (9), which is moveable by means of two rollers (15), which are arranged on one axis, in slotted links (10), which are connected in a fixed manner with a cylinder head, whereby the intermediate lever (9) supports with one contour at an adjustment bar (11), which is conducted in a housing, and rolls with a work curve (16) on a roller (8) of a cam follower (7), and whereby the cam follower (7) acts with engagement areas, which are provided bottom-sided, respectively, on a hydraulic adjustment element (6) and a valve (5) of a combustion engine.

20 Claims, 3 Drawing Sheets

FOREIGN PATENT DOCUMENTS

Figure 1:
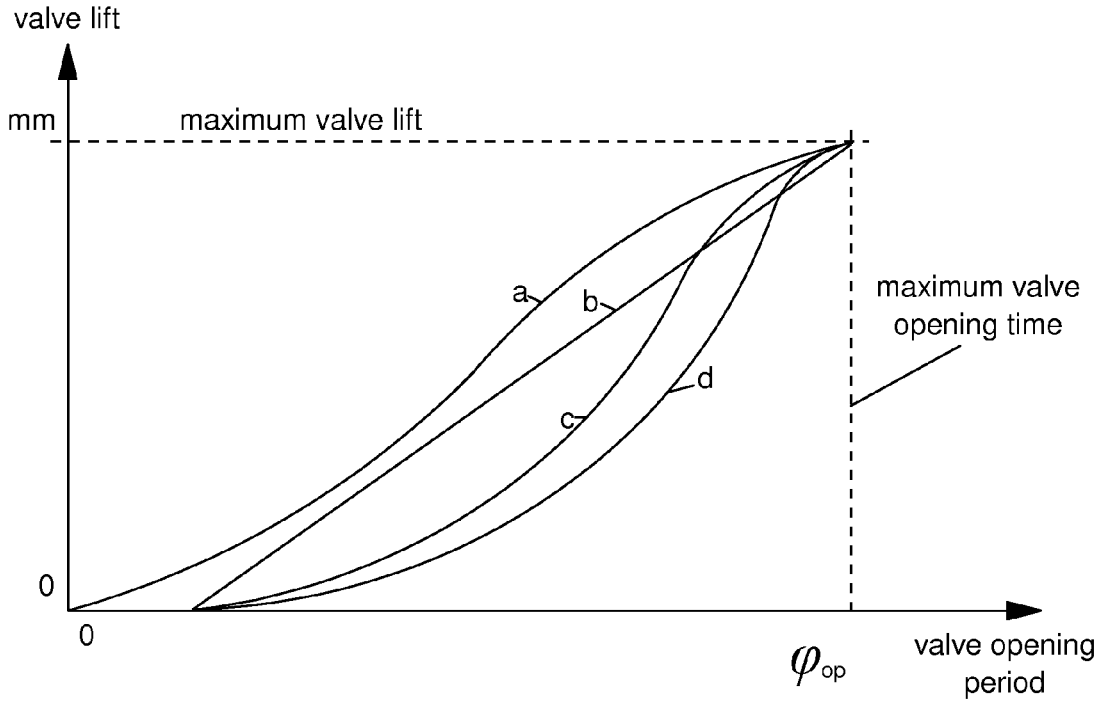

| | | |
|---|---|---|
| DE | 3637373 | 11/1988 |
| DE | 4223173 | 1/1994 |
| DE | 4326331 | 2/1995 |
| DE | 19914044 | 9/2000 |
| DE | 10036373 | 2/2002 |
| DE | 10140635 | 4/2003 |
| EP | 0111768 | 6/1984 |
| EP | 1031705 | 8/2000 |
| EP | 1255027 | 11/2002 |
| GB | 190906650 | 10/1909 |
| JP | 7-63023 | 3/1995 |
| WO | WO9509298 | 4/1995 |

VARIABLE VALVE LIFT CONTROL SYSTEM FOR A COMBUSTION ENGINE WITH UNDERNEATH CAMSHAFT

The invention relates to a variable valve lift control system for a combustion engine with underneath camshaft according to the preamble of the patent claim 1.

Combustion engines with underneath camshaft and with a valve operating mechanism via push rods are known as Diesel engines and Otto engines. With these engines, the opening time respectively the closing time of the inlet valve cannot be changed independently from the closing point of the outlet valve, because the opening times of the inlet valve and of the outlet valve are determined in a camshaft, and a phase adjustment unit on the camshaft always shifts both opening times parallelly compared with the crank shaft. Thereby, the phase adjustment unit is at least provided on the inlet camshaft in order to control by means of the so-called early inlet-closing the load of the combustion engine in an optimal consumption. Because in engines with an underneath camshaft the inlet spreads and outlet spreads are determined in the camshaft, an optimal adjustment of an inlet closing time with respect to consumption, torque and emission is not possible load-dependently and rotational speed-dependently. For Diesel engines, it is known controlling the twist of the in-cylinder-flow by means of the dependent adjustment of the inlet valve lift, without using a separate swirl duct.

From the DE 36 373 A1 a valve lift control system is known by means of which the rotary motion of control shafts, which have lifters or push rods, in single valves or valve groups, during the operation of the power machine for a choke-free load control or a cylinder switch-off, the valve lift length can be adjusted in a step-less manner from a maximum lift length up to a continuous closing, and a step-less phase shifts of the valve actuation can be taken, wherein the lifters themselves are driven by means of rocker levers or swing arms, and accordingly actuate the valves by means of the engagement into further rocker levers or swing arms.

From the DE 175 16 90 and DE 225 10 91, valve control devices are known for internal combustion engines, which change the valve lift of a valve load-dependently and rotational speed-dependently for combustion engines with overhead camshaft, and from the DE 199 140 44 a rocker lever is known, which is integrated within a cylinder of a valve operating mechanism of an internal combustion engine, and which can be switched off from the cam lift, and which can be moved with its axis in a slotted hole of a bearing block lengthwise, and which is connected by means of blocking elements with the bearing block, respectively is detached from the bearing block by means of said blocking elements in order to realize a zero-lift of a valve.

It is an object of the present invention producing a valve lift control system for combustion engines with underneath camshaft, by means of which the valve lift of at least one inlet valve and/or outlet valve can be adjusted load-dependently and rotational speed-dependently, by means of which simultaneously coupled with the valve lift also the opening time of the valve is adjusted, and additionally by means of which the adjustment of a zero-lift of the valves, individual cylinders of an internal combustion engine can be shut down, in order to reduce the fuel consumption.

This object is achieved by means of the features in the characteristic of the patent claim 1, wherein an underneath camshaft drives by means of a push rod via a hydraulic valve clearance adjustment element a rocker lever, which has a curve contour, which runs on a roller of an intermediate lever, which is movable by means of two rollers, which are arranged on one axis, in slotted links, which are connected in a fixed manner with a cylinder head, whereby the intermediate lever supports with an engagement area at an adjustment bar, which is conducted in a housing, and which rolls with a work curve on a roller of a cam follower, and whereby the cam follower acts on a hydraulic adjustment element and a valve of a combustion engine by means of engagement areas, which are provided bottom-sided respectively.

It is preferred adjusting by means of a shift of the adjustment bar the region of the work curve of the intermediate lever, which is used with the roller of the cam follower in one rotation of the camshaft. Therewith, a valve lift and dependent thereof the opening time of the inlet valve and outlet valve is adjusted.

Thereby that inter alia the work curve of the rocker level determines the opening characteristic of the valve, the work curve is in particular constructed from several individual regions, in a such a manner that a first region determines a zero-lift, which is defined by means of a circular arc around the center of the roller of the intermediate lever, following at it a second region, which defines the opening ramp, and following at it a part-lift region and a full-lift region, whereby the individual regions are connected with each other by means of transition radii, and that over the total curve region a spline is laid in order to connect the curve regions with each other without shock.

Furthermore, it is preferred that by means of an embossment of the camshaft, by means of the curve contour of the rocker lever and by means of the work curve of the intermediate lever, the opening characteristic of the valve is determinable.

A preferred embodiment is seen therein that the work curve, which as yet was arranged on the intermediate lever in a known manner, is now arranged on the cam follower, and that the previous roller of the cam follower is constituent part of the intermediate lever.

In another embodiment, the rocker lever has an additional roller, which is in direct connection with the roller of the intermediate lever, which runs at the slotted link.

A likewise advantageous embodiment is seen therein that the intermediate lever is conducted axially through a leg spring or through a slotted link with a lateral line.

Another preferred embodiment is seen therein that the intermediate lever supports with a circular contour at the adjustment bar, whereby said contour can also support on a roller, which is bedded in a friction bearing or an anti-friction bearing.

Another likewise advantageous embodiment is that the adjustment bar shows a contact contour, for example in a shape of a circular arc, concave, ascending and sloping, because by means of the form of the contact contour of the adjustment bar inter alia also the acceleration behavior of the valve of the internal combustion engine is influenced.

In one embodiment of an internal combustion engine with several inlet valves and outlet valves, the valves with different valve lifts and therewith coupled with different opening times, are thereby adjusted that by means of several adjustment bars, which are adjustable by means of individual actuators, the corresponding set value is calculated by means of a process-controlled engine characteristic or by means of a program-controlled model.

A major advantage of said variable valve lift control system of Diesel engines consists therein that by means of an individual control of the valve lift of, for instance, two inlet valves, the twist of the in-cylinder flow can be adjusted, and the major advantage of Otto engines consists therein that, for instance, in case of two inlet valves, the in-cylinder flow can be adjusted in such a manner that the combination with a fuel injection valve, which injects the fuel directly into the combustion chamber, is facilitated in broad operating ranges. The combination of a fuel inlet valve, which injects directly, with a valve operating mechanism with underneath camshaft facilitates new possibilities in the arrangement of the fuel injection valve within the combustion chamber, because a limitation by means of an overhead camshaft is not existent.

Advantageous alternatives of the embodiments are seen therein that either the adjustment element is omitted or that only one valve clearance adjustment element is applied.

Furthermore, it is also preferred providing the intermediate lever formed from aluminum or from a titanium alloy.

Further advantageous embodiments are seen therein that either all rollers are bedded in anti-friction bearings, or that the rollers are bedded in anti-friction bearings and friction bearings, and that the rocker level is bedded in an anti-friction bearing or a friction bearing.

It is essential for the new variable valve lift control system for a combustion engine with underneath camshaft that thereby the valve lift of one or more inlet valves and/or outlet valves can be adjusted load-dependently and rotational speed-dependently, that simultaneously coupled with the valve lift also the opening time of the valves is adjusted, and that additionally by means of the adjustment of a zero-lift of the valves, individual cylinders of an internal combustion engine can be shut down. It is achieved by means of this manner that the fuel consumption is reduced.

In the following, the invention is exemplified by means of preferred embodiments, which are presented in the figures.

Figure 3:
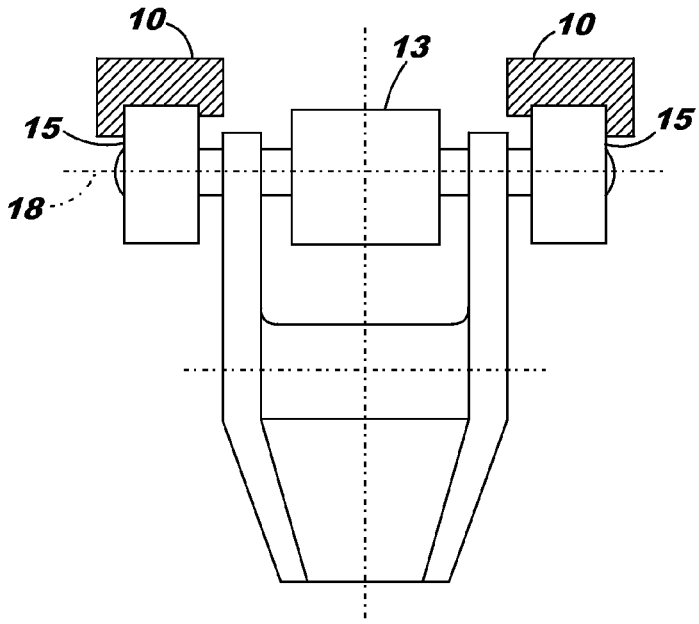
Figure 2:
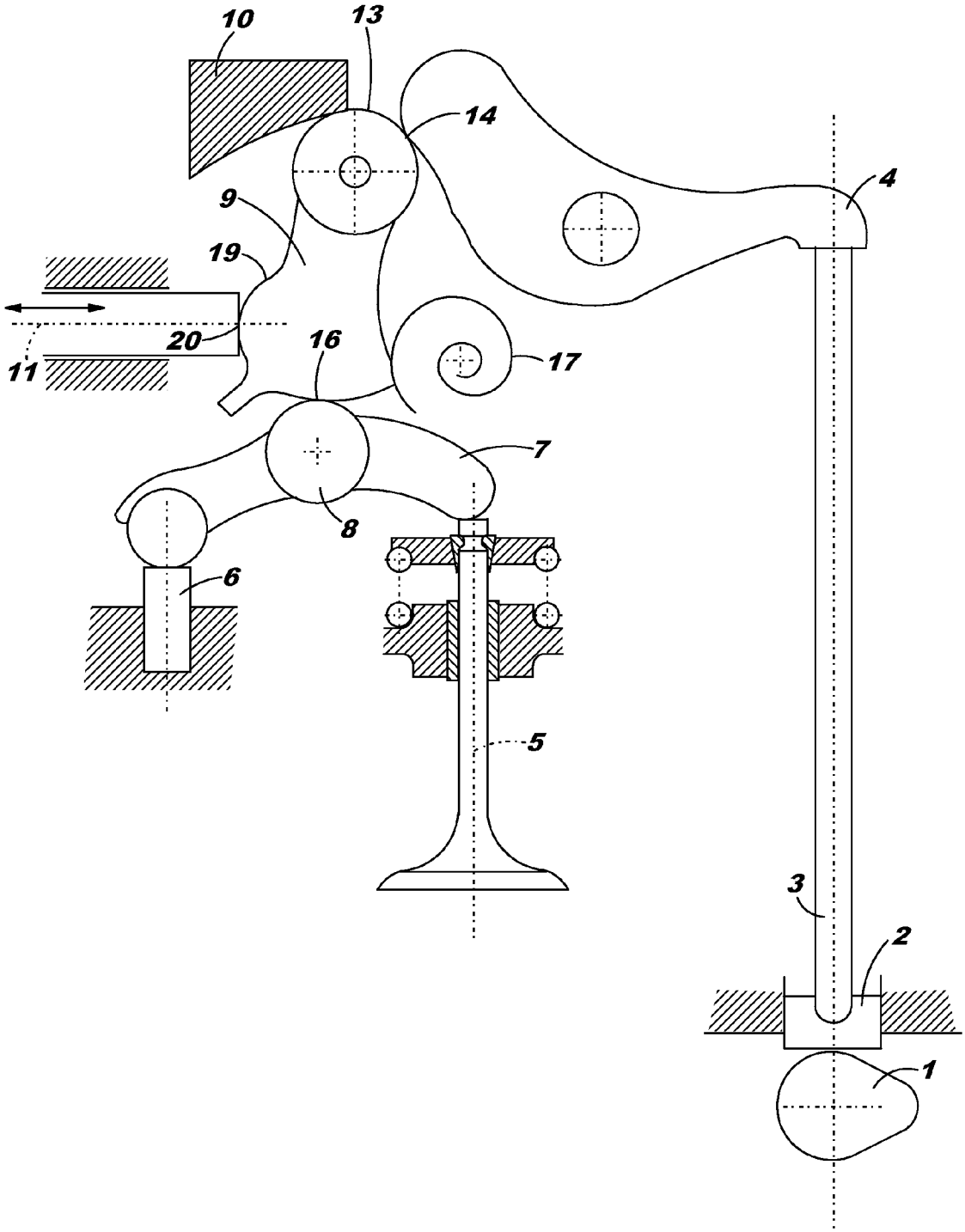
Figure 4:
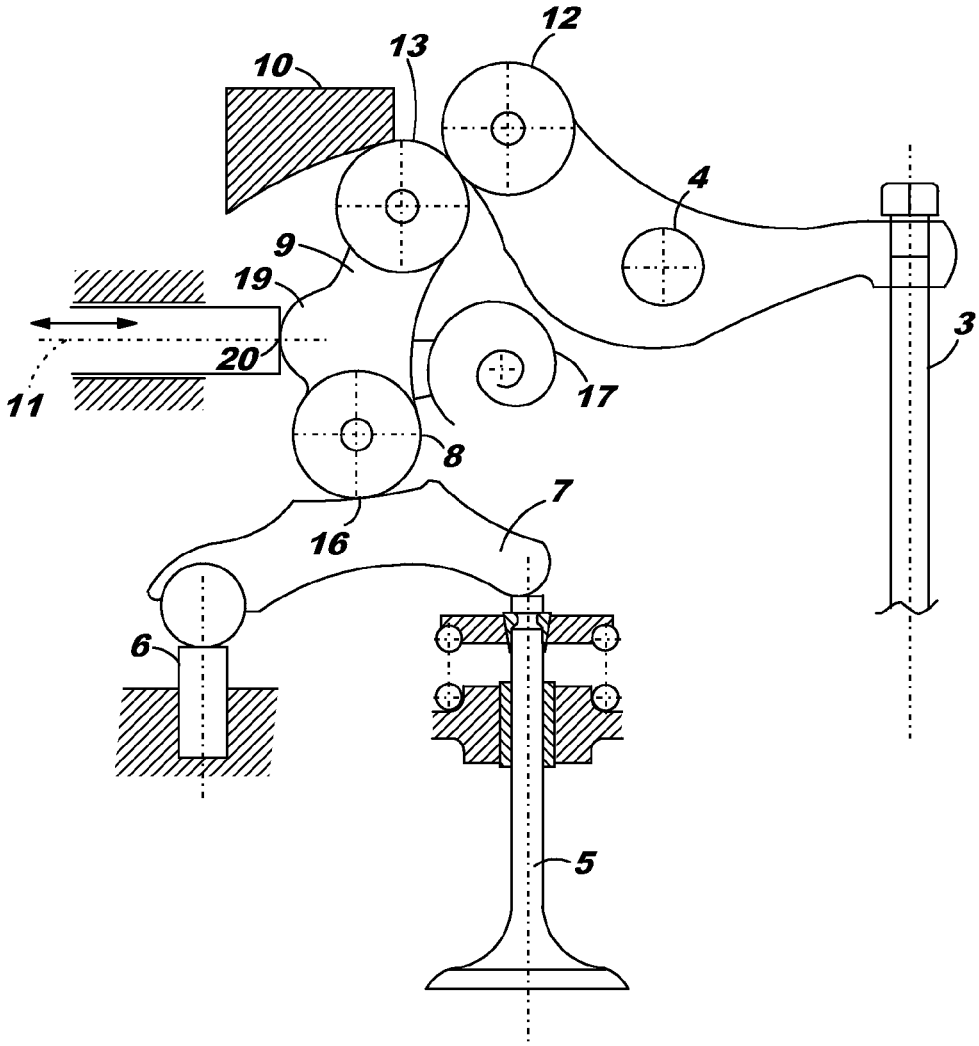
Figure 5:
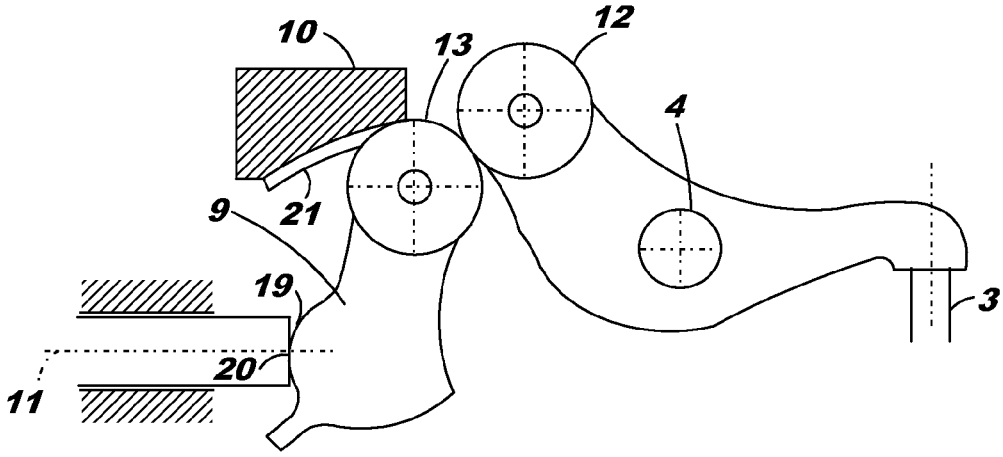

Shown is by:

FIG. 1 an opening characteristic of a valve;

FIG. 2 a first embodiment of a valve control system;

FIG. 3 the first embodiment in lateral view;

FIG. 4 a second embodiment of a valve control system;

FIG. 5 a third embodiment of a valve control system.

For a valve operating mechanism, for which together with the valve lift also the opening time is changed, according to FIG. 1 also the overcutting and the inlet closing time are adjusted load-dependently and rotational speed-dependently. In particular, it is possible minimizing the overcutting in the idle-running in order to improve the idle-running quality, controlling in the part-load operational range the overcutting and therewith the residual gas portion by means of the valve lift, and improving for the full-load by means of a control of the inlet valve closing the torque and the performance. This takes place by means of the first embodiment of a valve lift control system, which is shown in FIG. 2, with the different characteristics a, b, c and d, which are shown in FIG. 1. Because, for the new valve operating mechanism according to the invention, a compromise between idle-running quality and maximum performance has not longer to be considered, as it is the case for determined overcuttings respectively determined control times, for high rotational speed also a valve lift can be driven with an opening time, which was common as yet for sport engines, which could set aside any idle-running quality.

The effectiveness of the technical solution according to the invention is improved as to the fuel consumption by means of an additional phase slider on the camshaft, by means of which the fuel consumption in the part-load operational range is additionally improved in the load operational range without choke by means of an early inlet closing. With a phase slider on the camshaft, for a cold engine and for a cold catalyst, the outlet spread or the opening time of the outlet valve can be shifted in such a manner that energy-rich exhaust gas streams into the catalyst and heats up the catalyst faster.

A first embodiment of a valve lift operating mechanism with variable valve lift and an opening period, which is adjusted in dependence from the valve lift, is shown in FIG. 2. An underneath camshaft 1 drives by means of a push rod 3 and by means of a hydraulic valve clearance adjustment element 2 a rocker lever 4. The rocker lever 4 has a curve contour 14, which runs on a roller 13 of an intermediate lever 9. Thereby, the intermediate lever 9 is bedded on an axis 18. At the end of the axis 18 (FIG. 3), two rollers 15 are arranged. Thereby, the rollers 15 run in slotted links 10, which are connected with a cylinder head in a fixed manner. The intermediate lever 9 supports at an adjustment bar 11, which is conducted in a housing, and rolls with a work curve 16 on a roller 8 of a cam follower 7, which is bedded at a housing. The cam follower 7 supports on a hydraulic adjustment element 6 and a valve 5 of a combustion engine. By means of a shifting of the adjustment bar 11, the region of the work curve 16 of the intermediate lever 9 is adjusted with the roller 8 of the cam follower 7, which is applied in a rotation of the camshaft 1. Therewith, the valve lift and dependent thereof the opening time of a valve 5 is adjusted. The work curve 16 of the intermediate lever 9 is made from several individual regions. For instance, one region describes the so-called zero-lift, which is defined by means of a circular arc around the center of the roller 13. Following at it is a region, which defines the opening ramp, following at it there is a part-lift region and a full-lift region. All individual regions are connected with each other by means of transition radii. Then, a spline is laid across the total region, which connects all curve regions with each other without shock. In a similar manner, the curve contour 14 of the rocker lever 4 is formed. By means of an embossment of the camshaft 1, by means of the curve contour 14 of the rocker lever 4 and by means of the work curve 16 of the intermediate lever 9, the opening characteristic according to FIG. 1 of the cam mechanism is determined.

In a second embodiment according to FIG. 4, the work curve 16 is arranged at the cam follower 7 and the roller 8 is constituent part of the intermediate lever 9. The intermediate lever 9 furthermore supports according to FIG. 4 at a circular contour 19 at the adjustment bar 11. Said contour can also support in another, non-exemplified embodiment on a roller, which is bedded in a friction bearing or anti-friction bearing.

In a third embodiment according to FIG. 5, the rocker level 4 provides a roller 12, which runs directly with the roller 13 of the intermediate lever 9. The intermediate lever 9 can be conducted axially through a leg spring 17 or through a slotted link 10 with a lateral line 21. In another, non-exemplified embodiment, the adjustment bar 11 can also provide another contour, for instance circular arc-shaped, concave, ascending and sloping, whereby by means of the form of the contour 19 the intermediate lever 9 and the contact contour 20 of the adjustment bar 11 inter alia also the acceleration behavior of the valve 5 of the internal combustion engine is influenced.

In another non-exemplified embodiment, for an internal combustion engine with several inlet valves and outlet valves, the valves can be controlled with different valve lifts and coupled therewith with different opening times. Then, this can be carried out by means of several adjustment bars 11, which are controlled by means of individual actuators. Thereby, the corresponding set value is calculated by means of a process-controlled characteristic diagram, or by means of a program-controlled model. The control of the valve lift can also take place by means of several, non-exemplified eccentric shafts. For Diesel engines, by means of an individual control of the valve lift of, for instance, two inlet valves, the twist of the in-cylinder flow can be controlled.

In case of Otto engines, the individual control of, for instance, two inlet valves, the in-cylinder flow can be adjusted in such a manner, that the combination with a fuel injection valve, which injects the fuel directly into the combustion chamber, is facilitated in broad operating sectors. The combination of a fuel inlet valve, which injects directly, with a valve operating mechanism with underneath camshaft, facilitates new possibilities in the arrangement of the fuel injection valve within the combustion chamber, because a limitation by means of an overhead camshaft is not existent.

Advantageous alternatives of the embodiments are seen therein that either the adjustment element is omitted or that no valve clearance adjustment element is applied and the intermediate lever is formed from aluminum or a titanium alloy.

Further advantageous embodiments are seen therein that either all rollers are bedded by means of anti-friction bearings, or that the rollers are bedded by means of anti-friction bearings and friction bearings, and that the rocker level is bedded by means of an anti-friction bearing or a friction bearing.

Owing to the circumstances, another advantageous embodiment is seen therein that no adjustment elements have to be applied, and that then the valve clearance is mechanically adjustable at the rocker lever.

LIST OF REFERENCE NUMERALS

1 camshaft
2 valve clearance adjustment element
3 push rod
4 rocker lever
5 valve
6 adjustment element
7 cam follower
8 roller of the cam follower 7
9 intermediate lever
10 slotted link
11 adjustment bar
12 roller of the rocker lever 4
13 roller of the intermediate lever 9
14 curve contour of the rocker lever 4
15 roller
16 work curve of the intermediate lever 9
17 leg spring
18 axis
19 contour of the intermediate lever 9
20 contact contour of the adjustment bar 11
21 lateral line of the slotted link

The invention claimed is:

1. Variable valve lift control system for a combustion engine with underneath camshaft for the adjustment of a valve lift and of an opening time of at least one inlet valve and/or outlet valve load-dependently and rotational speed-dependently as well as for the switch-off of individual cylinders of an internal combustion engine, whereby rocker levers or swing arms, which are driven by means of cams of a camshaft, actuate the inlet valve and outlet valve by means of the engagement into further rocker levers or swing arms, characterized in that:

an underneath camshaft (1) drives by means of a push rod (3) via a hydraulic valve clearance adjustment element (2) a rocker lever (4), which has a curve contour (14), which runs on a roller (13) of an intermediate lever (9), which is moveable by means of two rollers (15), which are arranged on one axis, in slotted links (10), which are connected in a fixed manner with a cylinder head, whereby the intermediate lever (9) supports with a contour at an adjustment bar (11), which is conducted within a housing, and rolls with a work curve (16) on a roller (8) of a cam follower (7), and whereby the cam follower (7) acts with engagement areas, which are provided bottom-sided, respectively, on a hydraulic adjustment element (6) and a valve (5) of a combustion engine.

2. Variable valve lift control system according to claim 1, characterized in that by means of a shift of the adjustment bar (11), the region of the work curve (16) of the intermediate lever (9) is adjusted, which is applied with the roller (8) of the cam follower (7) in a rotation of the camshaft (1).

3. Variable valve lift control system according to claim 1, characterized in that the work curve (16) of the intermediate lever (9) is constructed from several individual regions, which are connected with each other by means of transition radii.

4. Variable valve lift control system according to claim 3, characterized in that the individual regions are constructed in such a manner that a first region determines a zero-lift, which is defined by means of a circular arc around the center of the roller (13), at it following a second region, which defines the opening ramp, and at it following a part-lift region and a full-lift region.

5. Variable valve lift control system according to claim 3, characterized in that a spline is laid over the total curve region (16) in order to connect the curve regions with each other without a shock.

6. Variable valve lift control system according to claim 1, characterized in that by means of an embossment of the camshaft (1), by means of the curve contour (14) of the rocker lever (4) and by means of the work curve (16) of the intermediate lever (9) the opening characteristic of the valve is determinable.

7. Variable valve lift control system according to claim 1, characterized in that the work curve (16) is arranged on the cam follower (7) and that the roller (8) is constituent part of the intermediate lever (9).

8. Variable valve lift control system according to claim 1, characterized in that the rocker lever (4) has an additional roller (12), which is in direct connection with the roller (13) of the intermediate lever (9), which runs at the slotted link (10) of the rocker lever (4).

9. Variable valve lift control system according to claim 1, characterized in that the intermediate lever (9) is conducted axially through a leg spring (17) or through a slotted link (10) with a lateral line (21).

10. Variable valve lift control system according to claim 1, characterized in that the intermediate lever (9) supports with a circular contour (19) at the adjustment bar (11).

11. Variable valve lift control system according to claim 1, characterized in that the intermediate lever (9) supports with a circular contour (19) on a roller, which is bedded in a friction bearing or anti-friction bearing.

12. Variable valve lift control system according to claim 1, characterized in that the adjustment bar (11) has a contact contour (20), in particular circular arc-shaped, concave, ascending and sloping.

13. Variable valve lift control system according to claim 1, characterized in that for internal combustion engines with several inlet valves and outlet valves the control of the valves with different valve lifts and coupled therewith with different opening times takes place by means of several adjustment bars (11), which are adjustable by means of individual actuators, and whereby the corresponding set value is calculated by means of a process-controlled engine characteristic or by means of a program-controlled model.

14. Variable valve lift control system according to claim 1, characterized in that for Otto engines and Diesel engines by means of an individual control of the valve lift of in particular two inlet valves the twist of the in-cylinder flow is adjustable.

15. Variable valve lift control system according to claim 1, characterized in that no valve clearance adjustment element (2) is provided.

16. Variable valve lift control system according to claim 1, characterized in that the intermediate lever (9) is formed from aluminum or from titanium alloy.

17. Variable valve lift control system according to claim 1, characterized in that the rollers (8, 12, 13, 15) are bedded in anti-friction bearings.

18. Variable valve lift control system according to claim 1, characterized in that the rollers (8, 12, 13, 15) are bedded in anti-friction bearings and friction bearings.

19. Variable valve lift control system according to claim 1, characterized in that the rocker lever (4) is bedded in an anti-friction bearing or a friction bearing.

20. Variable valve lift control system according to claim 1, characterized in that no adjustment elements (2, 6) are provided, whereby the valve clearance is mechanically adjustable at the rocker lever (4).

* * * * *